US006259014B1

(12) United States Patent
Qian et al.

(10) Patent No.: US 6,259,014 B1
(45) Date of Patent: Jul. 10, 2001

(54) ADDITIVE MUSICAL SIGNAL ANALYSIS AND SYNTHESIS BASED ON GLOBAL WAVEFORM FITTING

(75) Inventors: Xiaoshu Qian, Cupertino, CA (US); Yinong Ding, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 08/989,703

(22) Filed: Dec. 12, 1997

Related U.S. Application Data

(60) Provisional application No. 60/032,970, filed on Dec. 13, 1996.

(51) Int. Cl.[7] ..... G10H 1/08; G10H 1/12; G10H 7/10

(52) U.S. Cl. ..... 84/625; 84/660; 84/661; 84/DIG. 9

(58) Field of Search ..... 84/622–625, 627, 84/659–661, 663, DIG. 9

(56) References Cited

U.S. PATENT DOCUMENTS

| | | | | |
|---|---|---|---|---|
| 3,992,971 | * | 11/1976 | Chibana et al. | 84/625 |
| 4,135,422 | * | 1/1979 | Chibana | 84/625 X |
| 4,142,432 | * | 3/1979 | Kameyama et al. | 84/625 X |
| 4,961,364 | * | 10/1990 | Tsutsumi et al. | 84/622 X |
| 5,665,928 | * | 9/1997 | Wang | 84/621 |

* cited by examiner

*Primary Examiner*—Stanley J. Witkowski
(74) *Attorney, Agent, or Firm*—Carlton H. Hoel; W. James Brady; Frederick J. Telecky, Jr.

(57) ABSTRACT

This application describes a method for musical signal analysis and synthesis using global waveform fitting (GWF). GWF uses a sinusoidal model with quadratic phase. GWF tries to fit the entire data record (signal waveform) to the assumed signal model. The model parameters obtained by GWF have clear physical interpretations or meanings.

20 Claims, 5 Drawing Sheets

ADDITIVE MUSICAL SIGNAL ANALYSIS AND SYNTHESIS BASED ON GLOBAL WAVEFORM FITTING

This application claims priority under 35 U.S.C. § 119 (e)(1) of provisional application Ser. No. 60/032,970 filed Dec. 13, 1996.

This invention relates generally to methods for musical signal analysis and synthesis and, in particular, to analysis and synthesis of musical tones or notes using sinusoidal modeling.

BACKGROUND OF THE INVENTION

A generic analysis-based music synthesis system is depicted in FIG. 1. In the analysis part, a parametric representation of a music record is estimated using a musical sound model. In the synthesis part, the parametric representation or its transformation is used to produce a synthesized record.

The idea of creating musical sounds using sinusoidal models is at least a century old. See, C. Roads, *The Computer Music Tutorial* (1996 MIT Press) p.134, for a brief survey. The first music synthesizer *Talharmonium* produced complex tones by mixing sine wave harmonics from dozens of electrical tone generators. See, U.S. Pat. Nos. 580,035; 1,107,261; 1,213,803; and 1,295,691. The sinusoidal model is also the model used in most contemporary analysis-based music synthesis techniques, including pitch-synchronous analysis (J. C. Risset, et al., "Analysis of Musical Instrument Tones," *Physics Today, vol.* 22, no. 2, pp. 23–40 (1969)), synthesis heterodyne filter technique (J A Moorer, "*On the Segmentation and Analysis of Continuous Musical Sound By Digital Computer*," PhD Thesis, Stanford University (1975)), the phase vocoder (J. L. Flanagan et al., "Phase Vocoder," *Bell System Tech. Journal* (November 1966) and M. Dolson, "The Phase Vocoder: A Tutorial," *Computer Music Journal,* vol. 10, no. 4 (1986)), sinusoidal transformation system (STS) (R. J. McAulay et al., "Speech Analysis/Synthesis Based on a Sinusoidal Representation," *IEEE Trans. On Acoustics, Speech and Signal Processing,* vol. 34, pp. 744–754 (August 1986)), spectral modeling system (SMS) (X. Serra et al., "Spectral Modeling System: A Sound Analysis/Synthesis System Based on a Deterministic Plus Stochastic Decomposition," *Computer Music Journal,* vol. 14, no. 4 (1990), and ABS/OLA (E. B. George et al., "Analysis-by-Synthesis/Overlap-Add Sinusoidal Modeling Applied to the Analysis and Synthesis of Musical Tones," *Journal of Audio Engineering Society,* vol. 40, no. 6, pp. 497–516 (1992)).

Despite the power of the sinusoidal model, modeling the music signal exclusively with sinusoids can lead to an "information explosion" due to the large number of sinusoidal components needed for modeling the "noisy" component in the original sound or/and the many harmonics in the low-pitched musical sounds. The large volume of analyzed parameters can be cumbersome for musicians to manipulate and can also cause difficulties and/or high cost for storage in a synthesizer.

Two approaches have been used to reduce the number of model parameters. One approach is described in J. M. Grey, "*An Exploration of Musical Timbre*," PhD Thesis, Stanford University (1975) and the R. J. McAulay et al. article, referenced above. That approach estimates the model parameters (such as amplitude and frequency) only at certain "break" points (frame boundaries) rather than at every sample point. The parameters are subsequently interpolated to all sample points at the synthesis stage. The other approach is described in the X. Serra et al. article, referenced above. That approach models the "noisy" part of the original sound other than with sine wave clusters. The latter approach is advantageous because it not only makes the signal model more parsimonious, thus removing some of the artificial tonal quality sometimes perceived in the synthesized sound when the noisy component is modeled by orderly sine wave clusters, but it also makes the signal model more accurate. This invention builds on both approaches.

SUMMARY OF THE INVENTION

The invention provides novel methods for musical signal analysis and synthesis. The assumption is made that musical tones can be adequately modeled by the sum of a sinusoidal part and a non-sinusoidal part, as shown by equation (1) below. The non-sinusoidal part may be referred to as the stochastic part or "residual" of the analyzed signal.

$$s(t) = \sum_{m=1}^{M} A_m(t)\sin(\omega_m t + \theta_m(t)) + e(t). \tag{1}$$

In equation (1), the sinusoidal part is specified by amplitude tracks $A_m(t)$, nominal frequencies $\omega_m$ and phase deviation tracks $\theta_m(t)$ ($1 \leqq m \leqq M$). The residual, or stochastic part, is denoted by e(t). The invention provides mechanisms for estimating the model parameters and for developing a corresponding synthesis procedure to reconstruct the original tones or to transform and modify them to achieve desired musical effects.

Experiments have shown that different physical bases exist for generation of the sinusoidal and stochastic parts. The physics of some musical instruments requires that the sinusoidal and stochastic parts be handled separately and differently.

The invention provides ways to estimate the sinusoidal parameters and model the stochastic part. For the sinusoidal part, the model parameters are estimated by minimizing the error between the analyzed and the reconstructed signal waveforms in a least square sense. The minimization procedure is conducted over the entire signal duration. This is in contrast to the (short-time) Fourier transform based methods of McAulay et al., Serra et al. and George et al., above, where parameters are estimated on a frame-by-frame basis in order to account for the time-varying nature of the signal being analyzed. For this reason, the proposed analysis approach is referred to as a global waveform fitting (GWF method).

The advantages of GWF are its analysis accuracy and the resulting synthesis efficiency and quality. The analysis accuracy of the sinusoidal parameters is enhanced in GWF by removing two limitations of the frame-based Fourier methods: One limitation is that the parameters are estimated using only the signal waveform in the local data frame without "looking-ahead" or "looking-back." Another limitation is the well-known window effect caused by truncating the signal waveform. In GWF, the constraints imposed by the whole signal waveform on the local parameters are exploited and, therefore, the estimation resolution is not limited by the frame length. Another advantage of GWF is that it takes essentially an analysis-by-synthesis approach, and thus the synthesized waveform directly fits to the original waveform. This is contrary to the approach taken in Serra et al. and McAulay et al. wherein the model parameters are first estimated at frame boundaries and then the synthesized waveform is constructed from interpolated parameters.

The main benefits of GWF at the synthesis stage are the reduction of storage requirement and increase in computational efficiency. GWF reduces the parameters from three per frame to two per frame and eliminates one of the three additions to compute a phase sample. It is hoped that this reduction in resource requirement and the receding cost of high speed digital signal processors will finally bring the analysis-based additive synthesizer to reality. The increased accuracy of waveform fitting also translates into high fidelity of the synthesized sound.

BRIEF DESCRIPTION OF THE DRAWINGS

Embodiments of the invention have been chosen for purposes of illustration and description, and are shown with reference to the accompanying drawings, wherein.

DETAILED DESCRIPTION OF PREFERRED EMBODIMENTS

An example is described for an implementation useful in the analysis and synthesis of musical tones and/or notes.

1. Estimation of Sinusoidal Parameters

A global waveform fitting (GWF) approach is used to estimate the sinusoidal parameters by least square fitting the original signal to a sum of sinusoids. To do that, the sinusoidal components are first parameterized by modeling amplitude tracks and phase deviation tracks (hereafter called "phase tracks") respectively with linear and quadratic spline functions. A "linear spline function" is defined as a continuous piecewise linear polynomial. A "quadratic spline function" is defined as a piecewise quadratic polynomial with a continuous derivative. Using the spline function theory described in C. de Boor, "*A Practical Guide to Spline*" (Springer-Verlag New York, Inc. 1978), they can be expressed in terms of linear and quadratic basis splines ("B-splines" for short), respectively:

$$A_m(t) = \sum_{n=0}^{N} A_m^n \Lambda_n(t), \tag{2}$$

$$\theta_m(t) = \sum_{n=-2}^{N-1} \alpha_m^n B_n(t). \tag{3}$$

Figure 1:
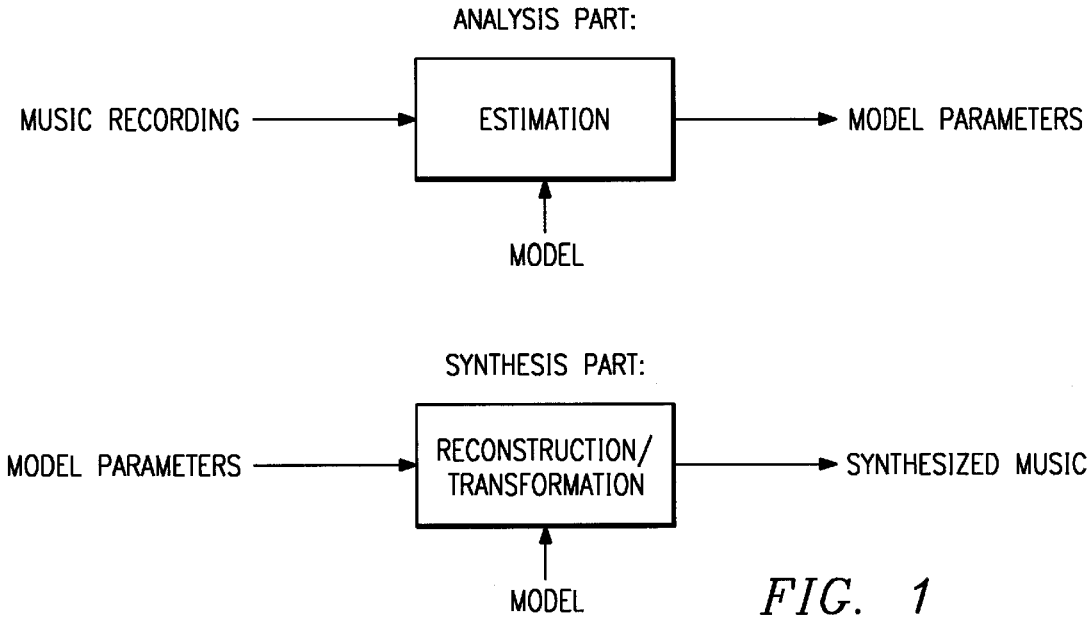
FIG. 1 is a block diagram of an analysis-based music synthesis system.
Figure 2:
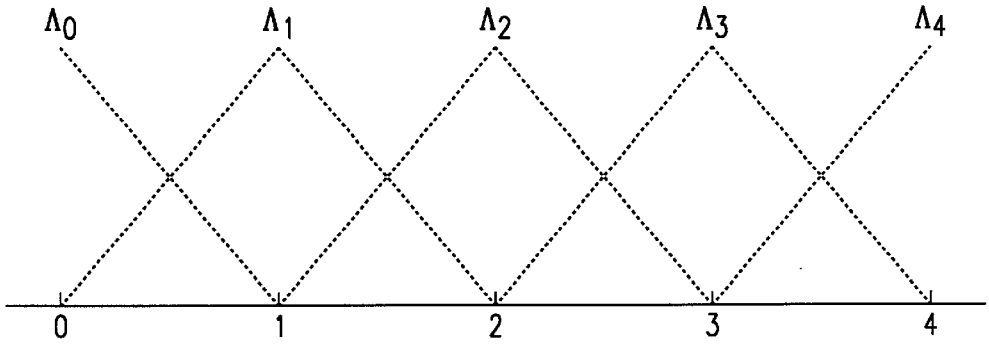
FIG. 2 is an illustration of the linear B-spline functions.

The notational convention used in the above two equations is as follows: The time axis is divided into N equally-spaced frames ($t_{11}$, $t_{11+1}$) ($0 \leqq n \leqq N$, $t_n = nL$), where L is the frame length. The linear B-spline $\Lambda_n(t)$ is a triangle window function centered at $t_n$ (FIG. 2). It is of unit height and of twice the frame length. It can be expressed as a shifted version of an even function $\Lambda(t)$, i.e.

$$\Lambda_n(t) = \Lambda(t - t_n)$$

where $$\Lambda(x) = \begin{cases} 1 - \frac{|x|}{L} & |x| < L \\ 0 & \text{otherwise} \end{cases}$$

Figure 3:
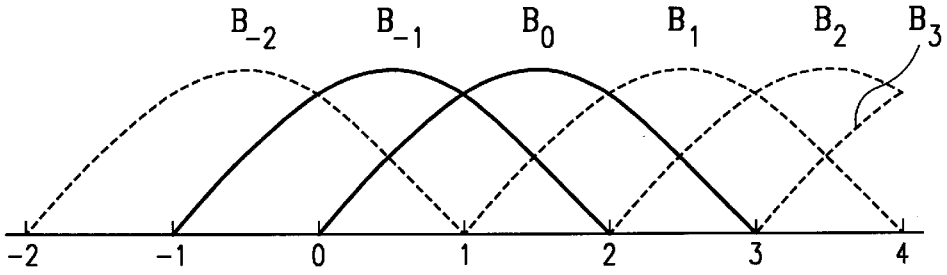
FIG. 3 is an illustration of the quadratic B-spline functions.

The quadratic B-spline $B_n(t)$ can also be considered as a symmetric window function (FIG. 3). The window spans three frames and is centered at $\frac{1}{2}(t_n + t_{n+3})$. Note the subscript n in $\Lambda_n(t)$ and $B_n(t)$ is not used in the same way: $t_n$ is the center of $\Lambda_n(t)$ but marks the start of the non-zero portion of $B_n(t)$. The center of $B_n(t)$ is at the mid-point of the nth frame ($t_{n+1}$, $t_{n+2}$). Formally, $B_n(t)$ is defined as a shifted version of an even function B(x), i.e.

$$B_n(t) = B(t - \tfrac{1}{2}(t_n + t_{n+3}))$$

where $$B(x) = \begin{cases} \frac{3}{4} - \left(\frac{x}{L}\right)^2 & \left|\frac{x}{L}\right| < \frac{1}{2} \\ \frac{1}{2}\left(\left|\frac{x}{L}\right| - \frac{3}{2}\right)^2 & \frac{1}{2} \leq \left|\frac{x}{L}\right| \leq \frac{3}{2} \\ 0 & \text{otherwise} \end{cases}$$

With equations (2) and (3), the sinusoidal components are parametrically represented by the B-splines coefficients, $A_m^n$ and $\alpha_m^n$. This parameterization scheme has two desirable properties: the amplitude and phase depend linearly upon their respective parameters; the amplitude, phase and frequency tracks are automatically constrained to be continuous, thus allowing the use of unconstrained optimization techniques to estimate the parameters. For the phase track, however, one might be tempted to a parameterization scheme that uses frequency parameters as a more musically meaningful alternative. For example, one can express phase track as an integral of frequency deviation track $$\theta_m(t) = \theta_m(0) + \int_0^t \omega'_m(u)du,$$

and model the frequency deviation track as a piecewise linear polynomial $$\omega'_m(t) = \sum_{n=0}^{N} \omega_m^n \Lambda_n(t).$$

This scheme is theoretically equivalent to the one using $\alpha_m^n$ described above. Unfortunately, the integration of the frequency deviation track in this scheme leads to cross-frame round-off error accumulation during the synthesis, and is thus preferably avoided.

In the novel GWF approach, the parameters $A_m^n$ and $\alpha_m^n$ are estimated by minimizing the following error function:

$$\left(\hat{A}_m^n, \hat{\alpha}_m^n\right) = \arg \min_{A_m^n, \alpha_m^n} \sum_{t=0}^{NL-1} \left( x(t) - \sum_{m=1}^{M} A_m(t) \sin(\omega_m t + \theta_m(t)) \right)^2, \quad (4)$$

where x(t) denotes the original musical tone at sample point t. For convenience, the sampling frequency is assumed to be 1 in equation (4). The whole minimization process takes three steps. In the first step, the nominal frequencies $w_m$ are estimated. The second step performs initial estimation of the amplitude and the phase parameters. These initial estimates are then used to initialize an iterative optimization procedure to obtain the final track estimates in the final step. These three steps are now described in more detail using a piano note (G3mf) as an example to illustrate the procedure.

A. Determination of Nominal Frequencies

Figure 6A:
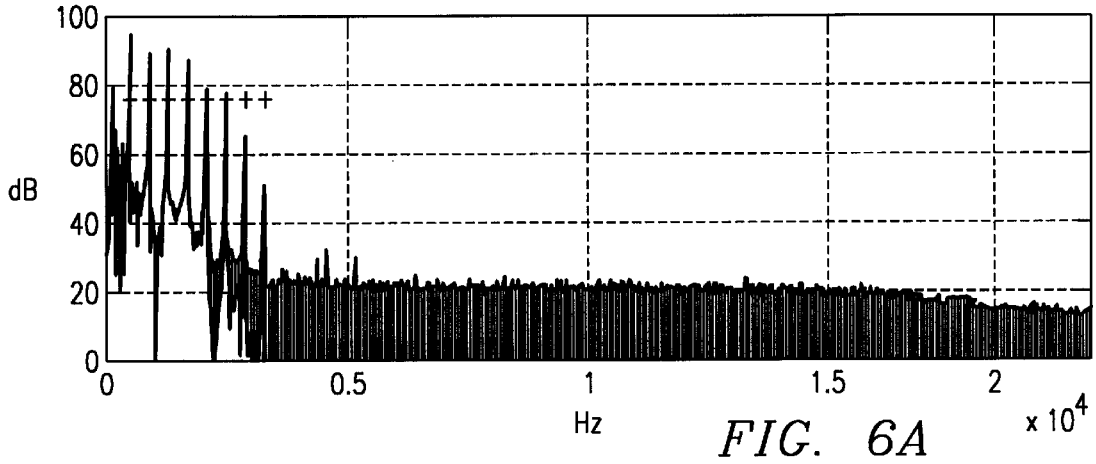
FIG. 6 is a graphical representation of the periodograms of the piano note G3mf.
Figure 6B:
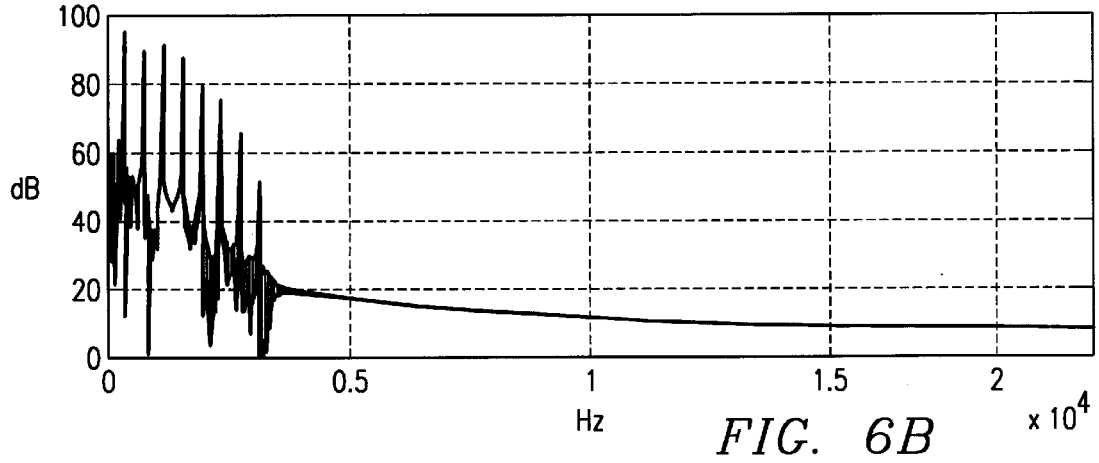
Figure 6C:
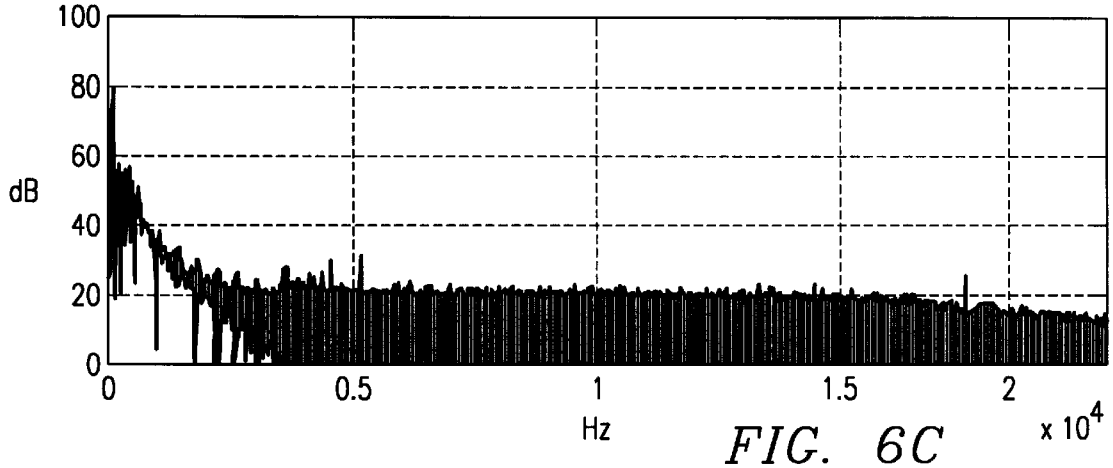
Figure 7:
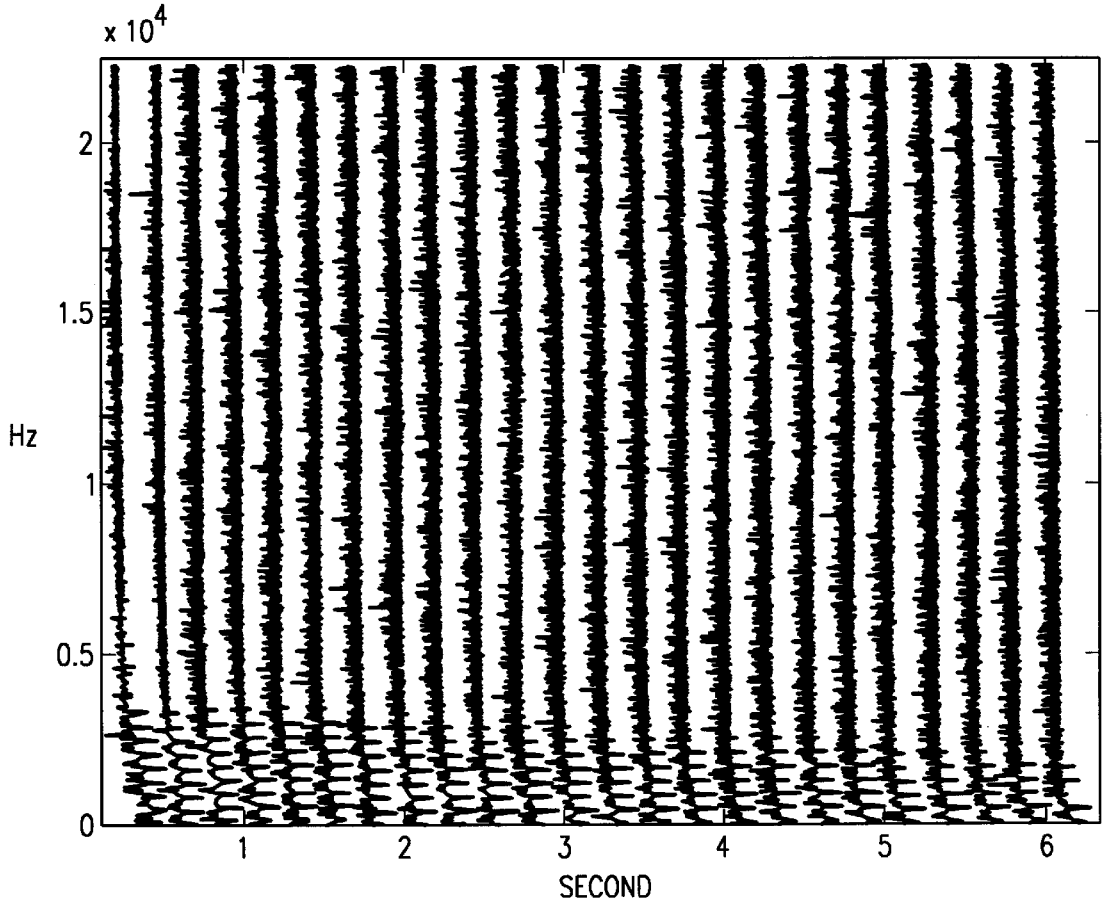
FIG. 7 shows a spectrogram representation of the piano note G3mf.

For musical tones, it was found that the nominal frequencies can be determined accurately enough by locating the peaks of signal periodograms. An interactive GUI-based MAT-LAB program was used to obtain nominal frequencies. The top panel of FIG. 6 shows the periodogram of the piano note G3mf with the nominal frequencies indicated by cross symbols. The spectrogram of the signal (see FIG. 7) was also plotted to see if any new frequency components could be read off that can be identified from spectrograms. This can happen if a frequency component lasts only a short period of time (say, e.g., only appears at the attack portion of the note) and thus may not appear as a clearly identifiable peak in the periodogram. The non-overlapping rectangular windows with a length of 100 nominal pitch periods is used in computing the spectrogram in FIG. 7. Even for signals such as piano tones that are normally considered to have a harmonic frequency structure, experience shows that using integer multiples of the pitch frequency as estimates of nominal frequencies is not always satisfactory because the frequencies of the high-end partials often deviate significantly from their nominal harmonic positions. This occurs very often for low-pitched signals.

B. Initial Estimates of Frequency and Phase Tracks

Figure 4:
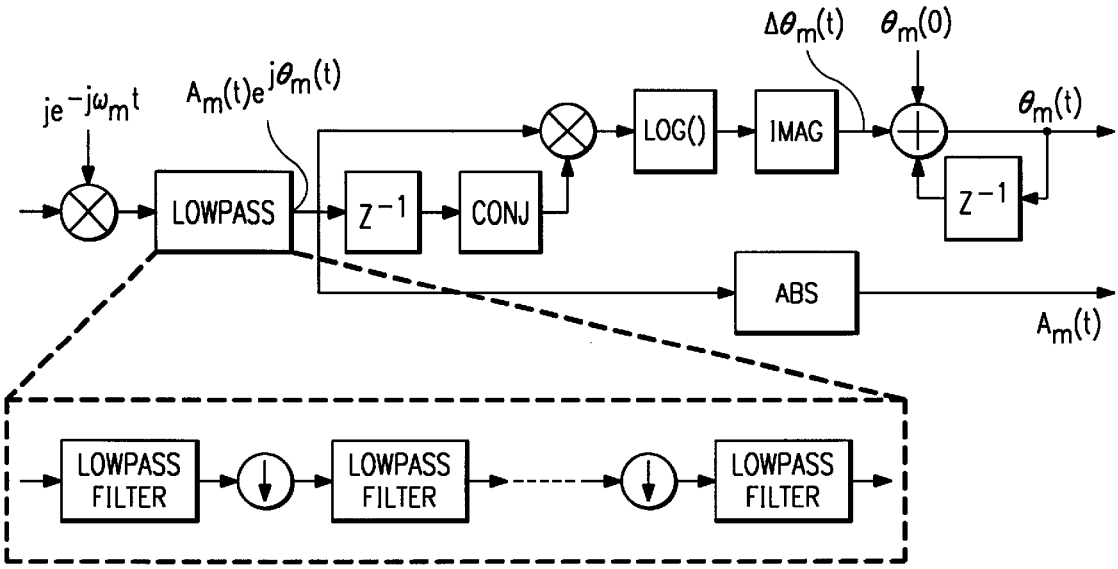
FIG. 4 is a functional block diagram of a system for extracting the amplitude and phase tracks.

The initial values of the amplitude and the phase parameters are estimated one frequency component at a time. For each component, the amplitude and phase deviation tracks are first extracted and then fit using linear and quadratic spline functions, respectively. The amplitude and the phase deviation tracks are extracted using a heterodyne filter technique (see, J. Moorer thesis, above), as shown in FIG. 4. At this step, the input signal is assumed to be a sum of M sinusoids $$\sum_{m=1}^{M} A_m(t) \sin(\omega_m t + \theta_m(t)). \quad (5)$$

After multiplying by $je^{jwmt}$, the signal was low pass filtered to yield $$A_m(t) e^{j\theta_m(t)}.$$

Note that a gain factor of two is also included by the lowpass filter. The amplitude track $A_m$ (t) can now be readily obtained by taking the absolute value of the lowpass filter output.

To extract the phase track, the following is first computed:

$$A_m(t) e^{j\theta_m(t)} \times A_m(t-1) e^{-j\theta_m(t-1)}$$

Then the imaginary part of its logarithm is taken as an estimate of the phase difference $\Delta\theta_m(t)$. The phase track $\theta_m(t)$ is then reconstructed from the phase difference and the initial phase. The latter can be easily determined from $A_m(0)e^{j\theta_m(0)}$. Once the amplitude and phase tracks are extracted, they are fit in the least square sense using linear and quadratic spline functions, respectively. Because $A_m$ (t) and $\theta_m$ (t) depend linearly on the spline coefficients, as shown in equations (2) and (3), the coefficients can be determined by solving linear equations.

As shown in FIG. 4, in practice, the low pass filter can be replaced in the heterodyning process with a cascade of lowpass filters and downsamplers. This serves two purposes. The downsampling reduces the data rate and thus alleviates the memory and the computational time requirements for the subsequent spline fitting procedure. Effecting the filtering and rate change in stages can also ease the filter design process see, L. B. Jackson, *Digital Filters and Signal Processing* (Kluwer Academic Publishers 1989). Typically, the pitch frequency is low compared with the sampling frequency and a large stop band attenuation is necessary for preventing the strong low frequency components from leaking into the weak high frequency components. Thus, the resulting narrow band filter often has a very severe specification. The filters in the multistage scheme, on the other hand, have a much milder specifications.

Another practical concern is that as the signal record gets longer, the matrix involved in spline fitting also gets larger, causing difficulties in memory, computational efficiency and numerical stability. To handle the case of a long data record, the data record is divided into overlapping segments and the spline fitting is done for each segment separately. The segment is typically about one-half second long with four data frames (about five milliseconds long) overlapping between adjacent segments. When two segments overlap, the first two spline coefficients estimated from the second segment are discarded. Once these two are discarded, all other coefficients estimated from the second segment will override those estimated from the first segment whenever a choice is needed. Using this scheme, each frame loses about two data frames on the end that overlaps with its adjacent frame. This simple scheme worked well in conducted tests.

Figure 5A:
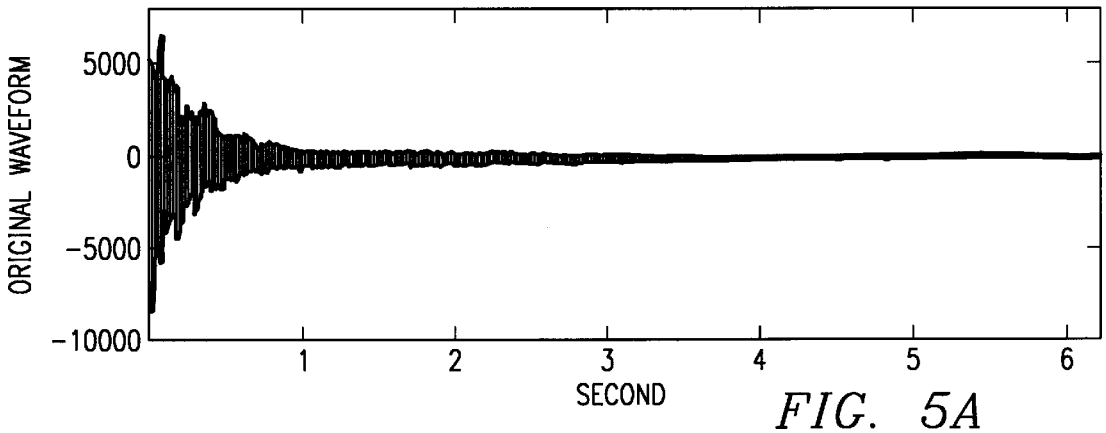
FIG. 5 is a graphical representation of the waveforms of the piano note G3mf.
Figure 5B:
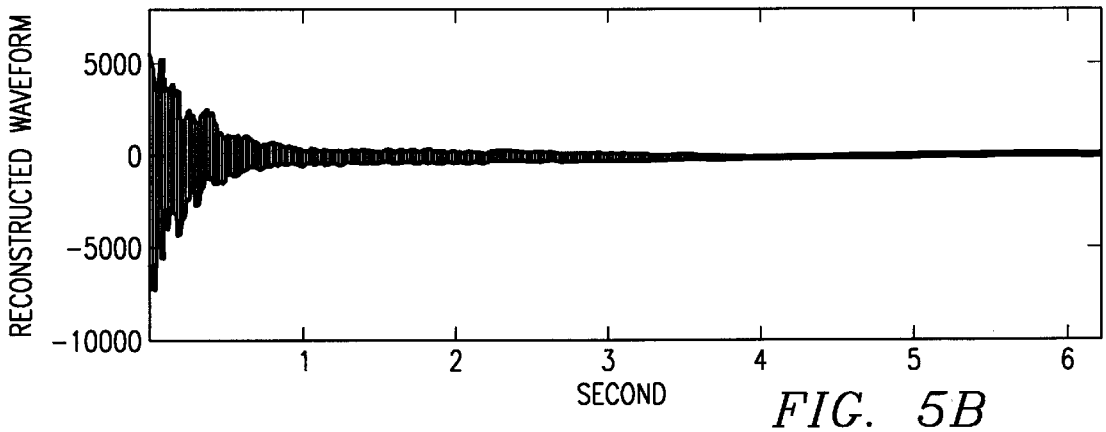
Figure 5C:
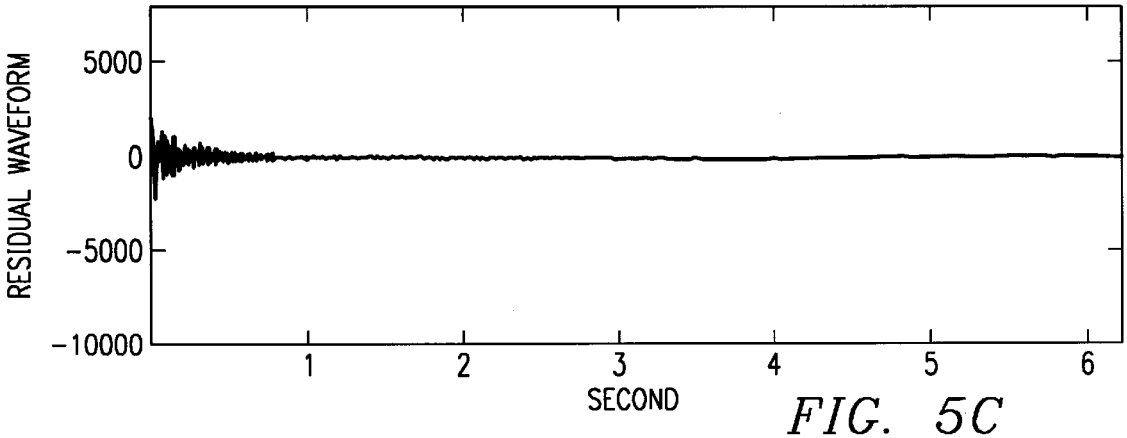
Figure 8A:
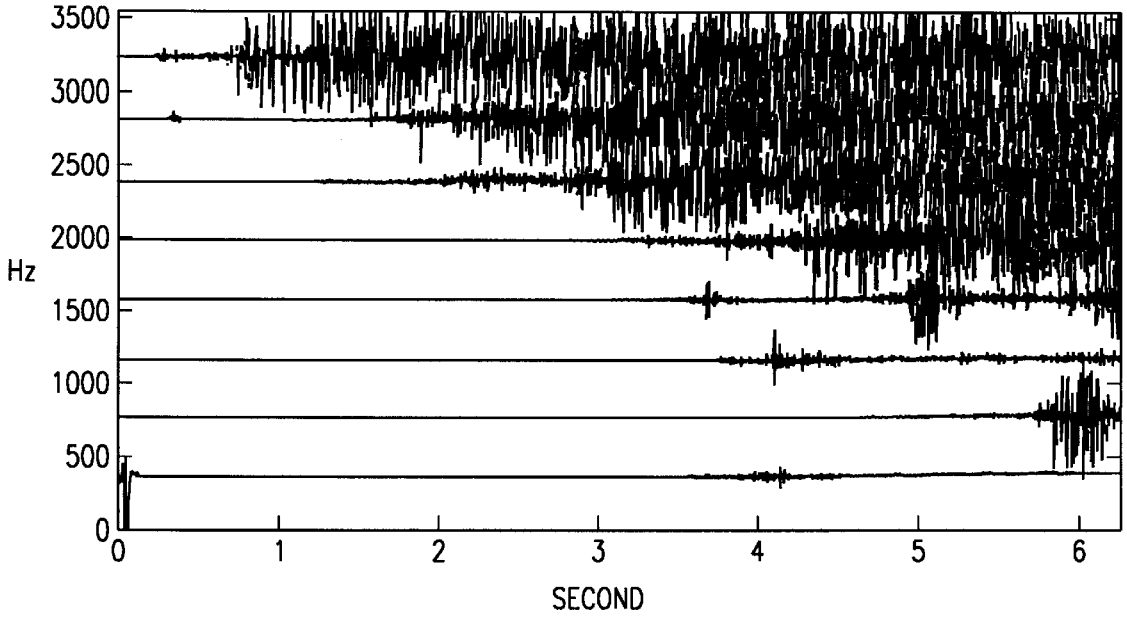
FIG. 8 shows the frequency and amplitude trace of the piano note G3mf.
Figure 8B:
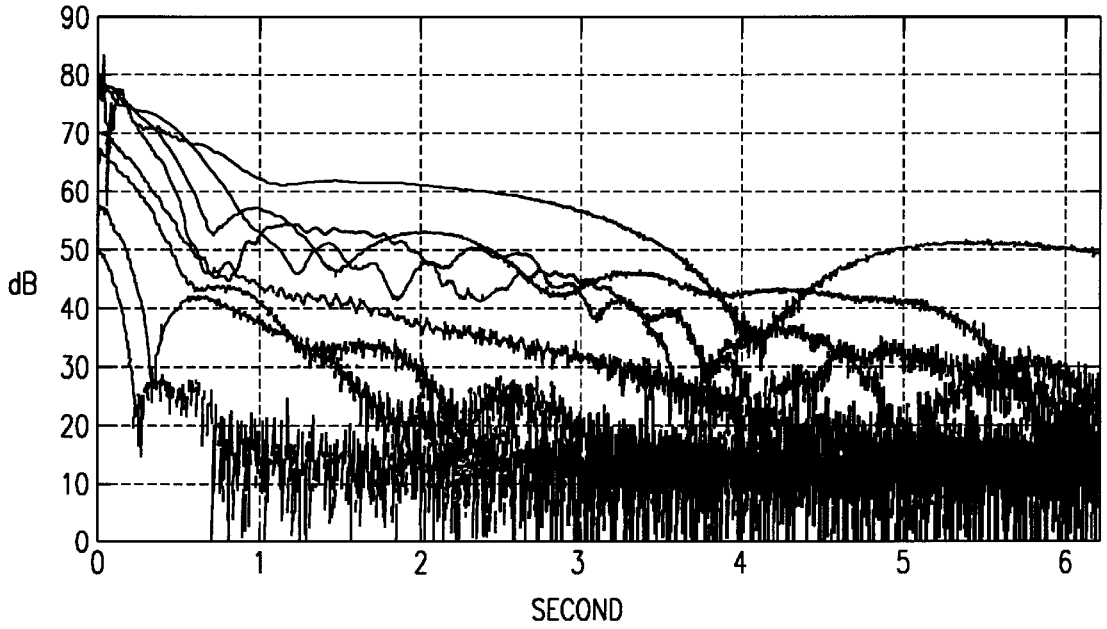

FIG. 5 shows the original waveform, the waveform reconstructed from the analyzed parameters and the residual waveform. FIG. 6 shows the periodograms of these three waveforms. FIG. 8 shows the analyzed amplitude and frequency tracks.

C. Minimization Procedure

Using equation (2), the signal in equation. (5) is expressed in matrix form as follows:

$$\sum_{m=1}^{M} A_m(t) \sin(\omega_m t + \theta_m(t)) = \sum_{n=1}^{N} \sum_{m=1}^{M} A_m^n \Lambda_n(t) \sin(\phi_m(t)) = Ha \quad (6)$$

where $\phi_m(t)$ denotes $w_m t + \theta_m(t)$, $$\alpha = [A_{10} A_{20} \ldots A_{M0} \ldots A_{1N} A_{2N} \ldots A_{MN}]^T$$

and H is an NL by (N+1)M matrix. The non-zero elements in H can be organized into N blocks: each block is L by 2M. The nth block is positioned from row (n−1)L+1 through nL and column (n−1)M+1 through (n+1)M ($1 \leqq n \leqq N$), and is given by:

$$\begin{pmatrix} \Lambda(0)\sin(\phi_1((n-1)L)) & \cdots & \Lambda(0)\sin(\phi_M((n-1)L)) & \Lambda(L-1)\sin(\phi_1((n-1)L)) & \cdots & \Lambda(L-1)\sin(\phi_M((n-1)L)) \\ \Lambda(1)\sin(\phi_1((n-1)L+1)) & \cdots & \Lambda(1)\sin(\phi_M((n-1)L+1)) & \Lambda(L-2)\sin(\phi_1((n-1)L+1)) & \cdots & \Lambda(L-2)\sin(\phi_M((n-1)L+1)) \\ \vdots & \vdots & \vdots & \vdots & \vdots & \vdots \\ \Lambda(L-1)\sin(\phi_1(nL-1)) & \cdots & \Lambda(L-1)\sin(\phi_M(nL-1)) & \Lambda(1)\sin(\phi_1(nL-1)) & \cdots & \Lambda(1)\sin(\phi_M(nL-1)) \end{pmatrix}$$

Using the matrix notation, the objective function in equation (4) can be written as:

$$\|x-Ha\|^2 \tag{7}$$

where x is a column vector containing the recorded data samples. For any given parameters contained in H (i.e $\alpha_m^n$), expression (7) is minimized when σ is given by $$\alpha=H\#x \tag{8}$$

where H# denotes the pseudoinverse of H. The standard technique (see, G. H. Golub et al., "The Differentiation of Pseudo-Inverse and Nonlinear Least Squares Problems Whose Variables Separate," *SIAM Journal of Numerical Analysis,* vol. 10, pp. 413–432 (1973)) to minimize expression (7) is to use equation (8) to rewrite expression (7) as $$\|x-HH\#x\|^2 \tag{9}$$

and then minimize the latter over the parameters in H. This will restrict the parameter search space during the minimization to those in H. Once An $\alpha_m^n$'s are determined, α can be obtained from equation (8).

Expression (9) is minimized iteratively using a damped Gauss-Newton method, such as described in J. E. Dennis et al., *Numerical Methods for Unconstrained Optimization and Nonlinear Equations* (Prentice-Hall, 1983). To this end, expression (9) is denoted by f and is written as $$f=R'R$$

where $$R=x-HH\#x.$$

The term α is used to denote a vector formed by $\alpha_m^n$ parameters in H, and is used to denote its ith iterate. The initial estimate α(0) is obtained as previously described. To find search direction p=α−α(i) after the ith iteration, f is approximated by $$f\approx(R_i+J_ip)'(R_i+J_ip)=R_i'R_i+2R_i'J_ip+p'J_i'J_ip$$

where $R_i$ and $J_i$ denote matrix R and its Jacobian evaluated at α(i).The gradient of f computed from the above approximation is given by $$\tfrac{1}{2}\nabla f\approx J'R_i+J_i'J_ip.$$

Setting the above gradient to zero, it is seen that p can be obtained from the least square/min norm solution of $J_ip=-R_i$:

$$p=-J_i\#R_i.$$

Once the search direction is obtained, the next iterate can be obtained by $$\alpha(i+1)=\alpha(i)+\mu p$$

where $\mu$ is called a damped factor and can be obtained from a line search algorithm (see, J. E. Dennis et al., above).

2. Resynthesis of Sinusoids

The sinusoidal part can be reconstructed by summing M frequency components in equation (5). The evaluation of amplitude and phase samples of the mth frequency component at the nth data frame is considered next. Note that for the kth sample in the nth data frame, t=n L+k and 0≦k <L. Thus, the amplitude of the kth sample in the nth data frame can be written as $$A_m(nL+k)=A_m^n\Lambda_n(nL+k)+A_m^{(n+1)}\Lambda_{n+1}(nL+k) \tag{10}$$

$$=A_m^n\Lambda(k)+A_m^{(n+1)}\Lambda(L-k) \tag{11}$$

$$=A_m^n+\frac{A_m^{(n+1)}-A_m^n}{L}k. \tag{12}$$

From this, it is seen that the amplitude sample within the data frame can be computed recursively using only one addition $$A_m(nL+k)=A_m(nL+k-1)+\Delta A_m^n$$

where $$\Delta A_m^n=\frac{A_m^{(n+1)}-A_m^n}{T}, \tag{13}$$

$$A_m(nL)=A_m^n.$$

Similarly, the phase in the nth data frame can be expressed as a quadratic polynomial and a recursive algorithm found to compute the phase samples. Letting t=nL+k again, the phase deviation in the nth data frame can be written as $$\begin{aligned}\theta_m(t)&=\alpha_m^nB_n(t)+\alpha_m^{(n-1)}B_{n-1}(t)+\alpha_m^{(n-2)}B_{n-2}(t)\\&=\alpha_m^nB(k-1.5L)+\alpha_m^{(n-1)}B(k-0.5L)+\\&\quad\alpha_m^{(n-2)}B(k+0.5L)\\&=\alpha_m^n\frac{1}{2}\left(\left|\frac{k-1.5L}{L}\right|-\frac{3}{2}\right)^2+\\&\quad\alpha_m^{(n-1)}\left[\frac{3}{4}-\left(\frac{k-0.5L}{L}\right)^2\right]+\\&\quad\alpha_m^{(n-2)}\frac{1}{2}\left(\left|\frac{k+0.5L}{L}\right|-\frac{3}{2}\right)^2\\&=\alpha_m^n\frac{1}{2}\left(\frac{k}{L}\right)^2+\alpha_m^{(n-1)}\left[-\left(\frac{k}{L}\right)^2+\frac{k}{L}+\frac{1}{2}\right]+\\&\quad\alpha_m^{(n-2)}\frac{1}{2}\left(\frac{k}{L}-1\right)^2.\end{aligned}$$

Thus, if the quadratic phase in the nth data frame is expressed as $$\phi_m(t)=w_mt+\theta_m(t)=\alpha_m^n+b_m^nk+c_m^nk^2,$$

then $$\alpha_m^n=+w_mnL+\tfrac{1}{2}(\alpha_m^{(n-1)}+\alpha_m^{(n-2)}, \tag{14}$$

$$b_m^n = \omega_n + \frac{1}{L}(\alpha_m^{(n-1)} - \alpha_m^{(n-2)}), \tag{15}$$

$$c_m^n = \frac{1}{2L^2}(\alpha_m^n - 2\alpha_m^{(n-1)} + \alpha_m^{(n-2)}) = \frac{1}{2L}(b_m^{(n+1)} - b_m^n). \tag{16}$$

Thus, a phase sample can be calculated by two additions $$\overline{w}_m{}^n(k)=\overline{w}_m{}^n(k-1)+\Delta w_m{}^n, \tag{17}$$

$$\phi_m(nL+k)=\phi_m(nL+k-1)+\overline{w}_m{}^n(k), \tag{18}$$

where $$\overline{\omega}_m^n(0) = b_m^n - \frac{\Delta\omega_m^n}{2}, \tag{19}$$

$$\Delta\omega_m^n = \frac{b_m^{(n+1)} - b_m^n}{L}, \tag{20}$$

$$\phi_m(nL) = \alpha_m^n. \tag{21}$$

Given the amplitude and phase, one table look-up is used to compute the sinusoidal value and one multiplication is used to combine the amplitude and the sinusoid.

Accordingly, a method for musical signal analysis and synthesis using global waveform fitting (GWF) is described. GWF uses a sinusoidal model with quadratic phase. In contrast to the conventional time-frequency analysis approach, where model parameters are obtained by fitting data to the underlying signal model on a frame-by-frame basis, GWF tries to fit the entire data record (signal waveform) to the assumed signal model, and therefore has an excellent accuracy for ;reconstruction of the original waveform. In addition, since the model parameters obtained by GWF have clear physical interpretations or meanings, this make it much easier for musicians to modify the synthesis parameters derived from the model parameters to generate musically meaningful new sounds. The proposed analysis and synthesis procedures have been tested on musical notes of several different musical instruments. Excellent results have been observed.

Those skilled in the art to which the invention relates will recognize that other and further embodiments may be implemented and that changes, additions and modifications may be made to the described examples, without departing from the spirit and scope of the invention as defined by the claims.

What is claimed is:

1. A method for an electrical music signal processing, comprising:

representing a given electrical music signal by a model including a sum of sinusoidal components $$\sum_{m=1}^{M} A_m(t)\sin(\omega_m t + \theta_m(t));$$

the sinusoidal components being specified by amplitude parameters $A_m(t)$, nominal frequencies $\omega_m$ and phase deviation parameters $\theta_m(t)$ ($1 \leqq m < M$;

determining nominal frequencies tom corresponding to frequencies of the given signal;

determining initial values corresponding to amplitude and phase deviation parameters $A_m(t)$ and $\theta_m(t)$ for each nominal frequency tom using linear and quadratic spline functions, respectively;

applying the initial values in an iterative optimization procedure to obtain final values corresponding to amplitude and phase deviation parameters $A_m(t)$ and $\theta_m(t)$ through error minimization fitting between the given signal and the sum of sinusoidal components.

2. The method of claim 1, wherein the initial values corresponding to amplitude and phase deviation parameters are respectively determined using linear and quadratic basis spline functions $$A_m(t) = \sum_{n=0}^{N} A_m^n \Lambda_n(t) \text{ and}$$

$$\theta_m(t) = \sum_{n=0}^{N} \alpha_m^n B_n(t);$$

where a time axis of the given signal is divided into N frames ($0 \leqq n < N$), $\Lambda_n$ (t) is a triangle window function centered at $t_n$, and $B_n$ (t) is a window function whose non-zero portion starts at $t_n$; and wherein the sinusoidal components are parametrically represented by the spline function coefficients $A_m{}^n$ and $\alpha_m{}^n$.

3. The method of claim 2, wherein the window of $\Lambda_n$ (t) extends for two frames and the window of $B_n$ (t),ends for three frames and is centered at $\frac{1}{2}(t_n+t_{n+3})$.

4. The method of claim 2, wherein the final values of parameter representations $A_m{}^n$ and $\alpha_m{}^n$ are determined by minimizing an error function:

$$(\hat{A}_m^n, \hat{\alpha}_m^n) = \arg \min_{\hat{A}_m^n, \hat{\alpha}_m^n} \sum_{t=0}^{NL-1} \left( x(t) - \sum_{m=1}^{M} A_m(t)\sin(\omega_m t + \theta_m(t)) \right)^2,$$

where x(t) denotes the given signal at a sample point t and L is the frame length.

5. The method of claim 2, further comprising:

storing the spline function coefficients $A_m{}^n$ and $\alpha_m{}^n$; and synthesizing a signal corresponding to the given signal from the sum of sinusoidal components $$\sum_{m=1}^{M} A_m(t)\sin(\omega_m t + \theta_m(t))$$

using the stored spline function coefficients to develop amplitude and phase deviation coefficients of the synthesized signal.

6. The method of claim 5, wherein the synthesizing step comprises synthesizing a plurality of data frames of the synthesized signal; the amplitude of an mth frequency component in an nth data frame being determined by $$A_m(nL+k)=A_m(nL+k-1)+\Delta A_m{}^n,$$

where $$\Delta A_m^n = \frac{A_m^{(n+1)} - A_m^n}{T},$$

$A_m(nL)=A_m{}^n$ and L is the frame length; and the phase of the mth frequency component in the nth data frame being determined by $$\overline{\omega}_m{}^n(k)=\overline{\omega}_m{}^n(k-1)+\Delta\omega_m{}^n \text{ and}$$

$$\phi_m(nL+k)=\phi_m(nL+k-1)+\overline{\omega}_m{}^n(k);$$

where $\overline{\omega}_m{}^n(0)=b_m{}^n-\Delta\omega_m{}^n/2$, $\Delta\omega_m{}^n=(b_m{}^{(n+1)}-b_m{}^n/L)$ and $\phi_m(nL)=a_m{}^n$; and further where $a_m^n=\omega_m nL+\frac{1}{2}(\alpha_m^{(n-1)}-\alpha_m^{(n-2)})$ and $b_m^n=\omega_m+1/L(\alpha_m^{(n-1)}-\alpha_m^{(n-2)})$.

7. The method of claim 1, wherein at least some of the nominal frequencies $\omega_m$ are determined from peaks of a signal periodogram of the given signal.

8. The method of claim 1, wherein at least one of the nominal frequencies $\omega_m$ is determined from a spectrogram of the given signal.

9. The method of claim 1, wherein the initial representative values for the amplitude and phase deviation parameters $A_m(t)$ and $\theta_m(t)$ for at least one of the nominal frequencies $\omega_m$ are determined using a heterodyne filter.

10. The method of claim 1, wherein the initial representative values for the amplitude and phase deviation parameters $A_m(t)$ and $\theta_m(t)$ for at least one of the nominal frequencies $\omega_m$ are determined using a cascade of lowpass filters and downsamplers.

11. The method of claim 1, wherein the initial representative value for the amplitude parameter $A_m(t)$ for at least one of the nominal frequencies $\omega_m$ is determined by multiplying the given signal by $je^{-j\omega_m t}$, passing the multiplication result through a low pass filter, and taking the absolute value of the lowpass filter output.

12. The method of claim 1, wherein the initial representative value for the phase deviation parameter $\theta_m(t)$ for at least one of the nominal frequencies $\omega_m$ is determined by multiplying the given signal by $je^{-j\omega_m t}$;

passing the multiplication result through a low pass filter to yield $$A_m(t)e^{j\theta_m(t)};$$

computing the relationship $$A_m(t)e^{j\theta_m(t)}\times A_m(t-1)e^{-j\theta_m(t-1)};$$

determining a phase difference $\Delta\theta_m(t)$ from the imaginary part of the logarithm of that relationship; and reconstructing the parameter $\theta_m(t)$ from the phase difference and an initial phase.

13. The method of claim 1, wherein the given signal is divided timewise into overlapping time duration segments and spline function fitting is performed separately for different segments.

14. The method of claim 1, wherein the given signal is represented by the sum of sinusoidal components and a non-sinusoidal stochastic component denoted by e(t)

$$\sum_{m=1}^{M} A_m(t)\sin(\omega_m t+\theta_m(t))+e(t).$$

15. A method for music signal processing, comprising:

providing spline function coefficients $A_m^n$ and $\alpha_m^n$ as parametric representations of nth data frames of mth frequency components of a sum of sinusoids representation of an electrical music signal $$\sum_{m=1}^{M} A_m(t)\sin(\omega_m t+\theta_m(t)); \text{ and}$$

synthesizing data frames of a synthesized music signal based on the sinusoidal components; the amplitude of an mth frequency component in an nth data frame being determined by $$A_m(nL+k)=A_m(nL+k-1)+\Delta A_m^n,$$

where $$\Delta A_m^n=\frac{A_m^{(n+1)}-A_m^n}{T},$$

$A_m(nL)=A_m^n$ and L is the frame length; and the phase of the mth frequency component in the nth data frame being determined by $$\overline{\omega}_m^n(k)=\overline{\omega}_m^n(k-1)+\Delta\omega_m^n \text{ and}$$

$$\phi_m(nL+k)=\phi_m(nL+k-1)+\overline{\omega}_m^n(k);$$

where $\overline{\omega}_m^n(0)=b_m^n-\Delta\omega_m^n/2$, $\Delta\omega_m^n=(b_m^{(n+1)}-b_m^n/L)$ and $\phi_m(nL)=a_m^n$; and where $a_m^n=\omega_m nL+\frac{1}{2}(\alpha_m^{(n-1)}-\alpha_m^{(n-2)})$ and $b_m^n=\omega_m+1/L(\alpha_m^{(n-1)}-\alpha_m^{(n-2)})$.

16. A method for an electrical music signal processing, comprising:

representing a given electrical music signal by a model including a sum of sinusoidal components $$\sum_{m=1}^{M} A_m(t)\sin(\omega_m t+\theta_m(t));$$

the sinusoidal components being specified by amplitude parameters $A_m(t)$, nominal frequencies $\omega_m$ and phase deviation parameters $\theta_m(t)$ ($1\leqq m<M$);

determining nominal frequencies com corresponding to frequencies of the given signal;

determining initial representative values for amplitude and phase deviation parameters $A_m(t)$ and $\theta_m(t)$ for each nominal frequency $\omega_m$ using spline functions $$A_m(t)=\sum_{n=0}^{N} A_m^n\Lambda_n(t) \text{ and}$$

$$\theta_m(t)=\sum_{n=0}^{N} \alpha_m^n B_n(t);$$

where a time axis of the given signal is divided into N frames ($0\leqq n<N$) and wherein the sinusoidal components are parametrically represented by the spline function coefficients $A_m^n$ and $\alpha_m^n$;

applying the initial representative values in an iterative optimization procedure to obtain final amplitude and phase deviation parametrical representations $A_m^n$ and $\alpha_m^n$ through minimizing differences between the given signal and the sum of sinusoidal components representation using an error function.

17. The method of claim 16, wherein the final parameter representations $A_m^n$ and $\alpha_m^n$ are determined by minimizing the error function:

$$(\hat{A}_m^n,\hat{\alpha}_m^n)=\arg\min_{\hat{A}_m^n,\hat{\alpha}_m^n}\sum_{t=0}^{NL-1}\left(x(t)-\sum_{m=1}^{M} A_m(t)\sin(\omega_m t+\theta_m(t))\right)^2,$$

where x(t) denotes the given signal at a sample point t and L is the frame length.

18. The method of claim 17, further comprising storing the spline function coefficients $A_m^n$ and $\alpha_m^n$; and synthesizing a signal corresponding to the given signal from the sum of sinusoidal components $$\sum_{m=1}^{M} A_m(t)\sin(\omega_m t + \theta_m(t))$$

using the stored spline function coefficients to develop amplitude and phase deviation coefficients of the synthesized signal.

19. The method of claim 18, wherein the synthesizing step comprises synthesizing a plurality of data frames of the synthesized signal; the amplitude of an mth frequency component in an nth data frame being determined by $$A_m(nL+k)=A_m(nL+k-1)+\Delta A_m^n,$$

where $$\Delta A_m^n = \frac{A_m^{(n+1)} - A_m^n}{T},$$

$A_m(nL)=A_m^n$ and L is the frame length; and the phase of the mth frequency component in the nth data frame being determined by $$\overline{\omega}_m^n(k)=\overline{\omega}_m^n(k-1)+\Delta\omega_m^n \text{ and}$$

$$\phi_m(nL+k)=\phi_m(nL+k-1)+\overline{\omega}_m^n(k);$$

where $\overline{\omega}_m^n(0)=b_m^n-\Delta\omega_m^n/2$, $\Delta\omega_m^n=(b_m^{(n+1)}-b_m^n/L)$ and $\phi_m(nL)=a_m^n$; and where $$a_m^n=\omega_m nL+\tfrac{1}{2}(\alpha_m^{(n-1)}-\alpha_m^{(n-2)}) \text{ and}$$

$$b_m^n=\omega_m+1/L(\alpha_m^{(n-1)}-\alpha_m^{(n-2)}).$$

20. The method of claim 17, wherein the given signal is multiplied by $je^{-j\omega_m t}$; the multiplication result is passed through a low pass filter to yield $$A_m(t)e^{j\theta_m(t)};$$

the initial representative value for the amplitude parameter $A_m(t)$ for at least one of the nominal frequencies com is determined by taking the absolute value of the lowpass filter output; and the initial representative value for the phase deviation parameter $\theta_m(t)$ for the at least one of the nominal frequencies $\omega_m$ is determined by computing the relationship $$A_m(t)e^{j\theta_m(t)}\times A_m(t-1)e^{-j\theta_m(t-1)};$$

determining a phase difference $\Delta\theta_m(t)$ from the imaginary part of the logarithm of that relationship; and reconstructing the parameter $\theta_m(t)$ from the phase difference and an initial phase.

* * * * *